US006675689B2

(12) United States Patent
Núnez et al.

(10) Patent No.: US 6,675,689 B2
(45) **Date of Patent: *Jan. 13, 2004**

(54) CIRCULAR BLADE UNIT

(75) Inventors: Carmen Lira Núnez, St. Cloud, MN (US); James W. Reardon, St. Stephen, MN (US); Erhua Cai, St. Cloud, MN (US)

(73) Assignee: The Antioch Company, St. Cloud, MN (US)

( * ) Notice: Subject to any disclaimer, the term of this patent is extended or adjusted under 35 U.S.C. 154(b) by 193 days.

This patent is subject to a terminal disclaimer.

(21) Appl. No.: 09/793,198

(22) Filed: Feb. 26, 2001

(65) Prior Publication Data

US 2003/0154835 A1 Aug. 21, 2003

(51) Int. Cl.[7] ..... B26D 5/00; B26B 29/00

(52) U.S. Cl. ..... 83/745; 83/544; 83/565; 83/614; 30/151; 30/292; 30/294; 30/319

(58) Field of Search ..... 83/565, 574, 578, 83/745, 614, 544, 478, 485, 455, 456; 30/319, 292, 307, 162, 151, 391, 514, 294; D8/98

(56) References Cited

U.S. PATENT DOCUMENTS

| | | | | | |
|---|---|---|---|---|---|
| 312,043 | A | | 2/1885 | Van Horn | |
| 623,000 | A | | 4/1899 | Erkenbreck | |
| 794,013 | A | | 7/1905 | Hill | |
| 821,681 | A | * | 5/1906 | Vandermark | 30/292 |
| 1,255,657 | A | | 2/1918 | Steinheimer | |
| 1,358,973 | A | | 11/1920 | Minarcik | |
| 1,574,819 | A | | 3/1926 | Jezler | |
| 1,779,134 | A | * | 10/1930 | Kuechler | 30/292 |
| 1,983,778 | A | | 12/1934 | Rosenquist | |
| 2,366,017 | A | | 12/1944 | Fortune | |
| 2,695,447 | A | | 11/1954 | Maynard | |
| 3,734,106 | A | * | 5/1973 | Zimmerman | 132/311 |
| 4,020,550 | A | | 5/1977 | Okada | |
| 4,627,757 | A | * | 12/1986 | Manusch et al. | 401/194 |
| 5,012,582 | A | | 5/1991 | Bristol et al. | |
| 5,338,123 | A | * | 8/1994 | Obersteller et al. | 401/34 |
| 5,355,588 | A | | 10/1994 | Brandenburg, Jr. et al. | |
| D360,892 | S | * | 8/1995 | Birkholz et al. | D18/34 |
| 5,445,561 | A | | 8/1995 | Elmer | |
| 5,524,515 | A | * | 6/1996 | Boda | 83/455 |
| 5,555,631 | A | * | 9/1996 | Houston | 33/27.032 |
| D378,267 | S | | 3/1997 | Murkowski et al. | |
| D382,452 | S | | 8/1997 | Murkowski et al. | |
| D389,715 | S | | 1/1998 | Dustin et al. | |
| 5,711,077 | A | * | 1/1998 | Schulz et al. | 30/160 |
| 5,765,289 | A | | 6/1998 | Schulz et al. | |
| 5,819,618 | A | * | 10/1998 | Rodriguez | 83/455 |
| 5,823,086 | A | * | 10/1998 | McCormick | 83/565 |
| 5,979,056 | A | * | 11/1999 | Andrews | 30/49 |

(List continued on next page.)

*Primary Examiner*—Boyer D. Ashley

(57) ABSTRACT

A blade unit for cutting sheet material including a base member assembly mounting a circular blade and a cover member for detachable engagement with the base member assembly. The base member assembly includes a supporting wall having a circular upper edge and a guard flange extending around the circular upper edge and protecting a portion of an outer edge of the blade from contact. The base member assembly is further provided with a straight bottom edge and a portion of the blade extends below the bottom edge to define an exposed cutting edge for the blade. An elongated guide structure tab extends from the bottom edge parallel to and adjacent the exposed portion of the blade for guiding the blade unit along a slot in a guide template. The cover member is positionable in engagement with the base member assembly in a first, use position wherein a cavity of the cover member receives a portion of the base member assembly with the exposed portion of the blade located extending away from the cavity of the cover member. In a second position of the cover member relative to the base member assembly, the exposed portion of the blade is located within the cavity of the cover member to provide a protective cover over the exposed portion of the blade.

1 Claim, 5 Drawing Sheets

U.S. PATENT DOCUMENTS 5,983,499 A * 11/1999 Andrews ..... 30/29.5
6,098,515 A * 8/2000 Daley, Jr. ..... 83/455
6,216,577 B1 * 4/2001 Lira-Nunez et al. ..... 30/151
6,327,783 B1 * 12/2001 Ming ..... 30/286
6,375,376 B1 * 4/2002 Hsu ..... 401/247
6,438,580 B1 * 8/2002 Mears et al. ..... 709/204

* cited by examiner

CIRCULAR BLADE UNIT

BACKGROUND OF THE INVENTION

1. Field of the Invention

The present invention relates generally to a circular blade unit for cutting sheet material and, more particularly, to a circular blade unit which is adapted to be used with a template for a guided cutting system to cut sheet material, such as in an operation for cropping photographs.

2. Related Prior Art

In order to provide an attractive presentation of photographs in a scrapbook, the photographs are often cut or cropped, cutting away a peripheral portion of the photograph and leaving a central main subject portion of the photograph. Cropping of photographs provides an attractive border area for the photograph wherein the border area may be cut with a blade having a non-linear edge, such as a wavy or deckled edge.

Various devices have been proposed to facilitate the cropping operation including special scissors having wavy or deckled edges, and guided cutters such as the one disclosed in U.S. Pat. No. 701,828 to Arnold which incorporates a guide plate for guiding an arm movably supported on the plate to direct a cutting blade in a desired pattern for cutting sheet material. Other known guided cutting devices, such as for cutting circles or ovals, in a sheet of material include those incorporating a so called "Scottish yoke" mechanism which utilizes a base member supporting a pivoted arm and including two transversely oriented axes for guiding the arm in a controlled elliptical path. Typical examples of such devices are shown in U.S. Pat. No. 5,233,748 (Logan et al.) and U.S. Pat. No. 5,555,631 (Houston).

U.S. Pat. No. 3,456,346 (Snyder) discloses a circle cutter and protective cover in which the top of the cutter provides a handle for facilitating use of the cutter, and a removable cover is provided for protecting the bottom of the cutter from contact when not in use.

While known cutting devices provide the desired results of accurately following a desired shape, such devices are often complex and require assembly of several parts, and also are generally not well adapted to convenient and compact storage and transportation, a desirable attribute for equipment used by those involved in scrapbooking.

Accordingly, there is a need for an apparatus which facilitates cutting of sheet material and which requires a minimum of parts with accompanying reduced cost. In addition, there is a need for such an apparatus wherein a cutter is provided having means for protecting a user from contact with a cutting portion of the cutter when it is not in use.

SUMMARY OF THE INVENTION

In accordance with the present invention, a blade unit including a blade cartridge is provided for cutting sheet material. The blade unit includes a base member having opposing side portions and a bottom edge extending between the side portions. A blade is supported on the base member and includes an exposed portion extending past the bottom edge of the base member whereby the exposed portion of the blade is positioned to engage and cut material.

A cover member is provided for engagement with the base member, and the cover member includes wall portions defining a cavity for receiving the side portions of the base member therein. The wall portions of the cover member include opposing interior wall surfaces, and first and second detent members are provided on the opposing side portions of the base member and opposing interior wall surfaces of the cover member for cooperating with each other to hold the cover member in position on the base member.

The base member is positionable in engagement with the cover member in first and second positions, the first position comprising the first detent members located in engagement with the second detent members and the exposed portion of the blade located extending away from the cavity of the cover member. In the second position, the first and second detent members are located in engagement with each other with the exposed portion of the blade located extending into the cavity of the cover member.

In a further aspect of the invention, the blade comprises a circular blade supported for rotation on a pin extending through an aperture defined in the base member. In addition, the base member includes a substantially circular upper edge located adjacent the peripheral edge of the blade, and a guard flange is provided extending around the circular edge for preventing contact with the edge of the blade.

In another aspect of the invention, the bottom edge of the base member is provided with an elongated guide structure for engagement within a slot of a template to guide the blade unit along a desired cutting path.

DETAILED DESCRIPTION OF THE PREFERRED EMBODIMENT

Figure 1:
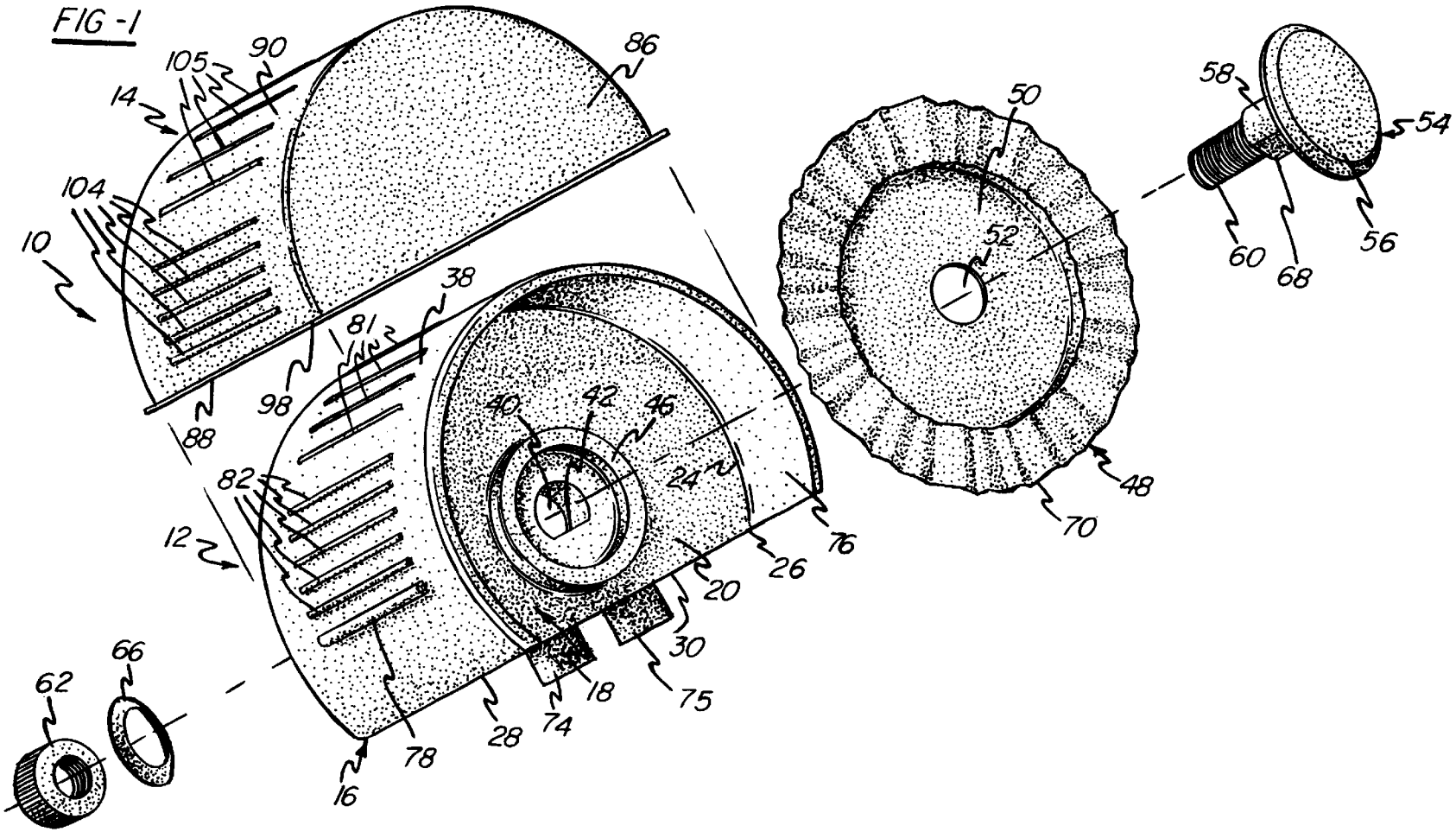
FIG. 1 is an exploded perspective view of the blade unit of the present invention.
Figure 2:
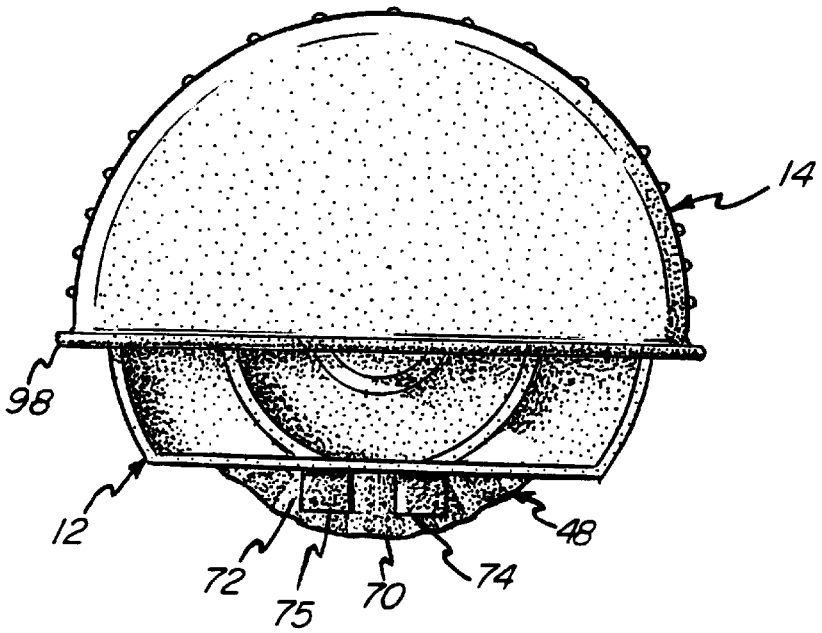
FIG. 2 is a rear side elevational view showing the blade unit in a use, cutting configuration.
Figure 3:
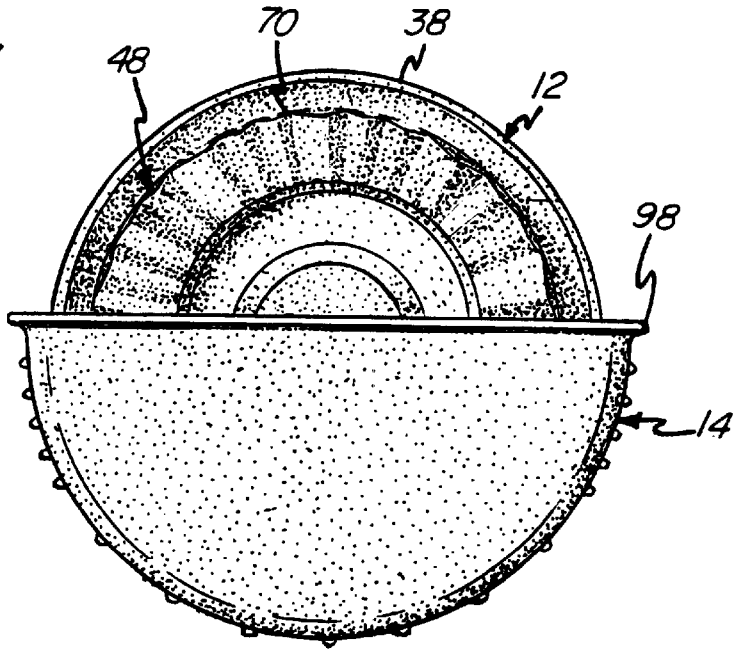
FIG. 3 is a front side elevational view showing the blade unit in a non-use, storage configuration.

Referring initially to FIG. 1, the blade unit 10 of the present invention generally includes a base member assembly 12, and a cover member 14 for engagement with the base member assembly 12. As will be described in greater detail below, the cover member 14 is positionable in engagement with the base member assembly 12 in first and second positions wherein the first position comprises a use or cutting position (FIG. 2), and the second position comprises a non-use or storage position (FIG. 3).

Figure 4:
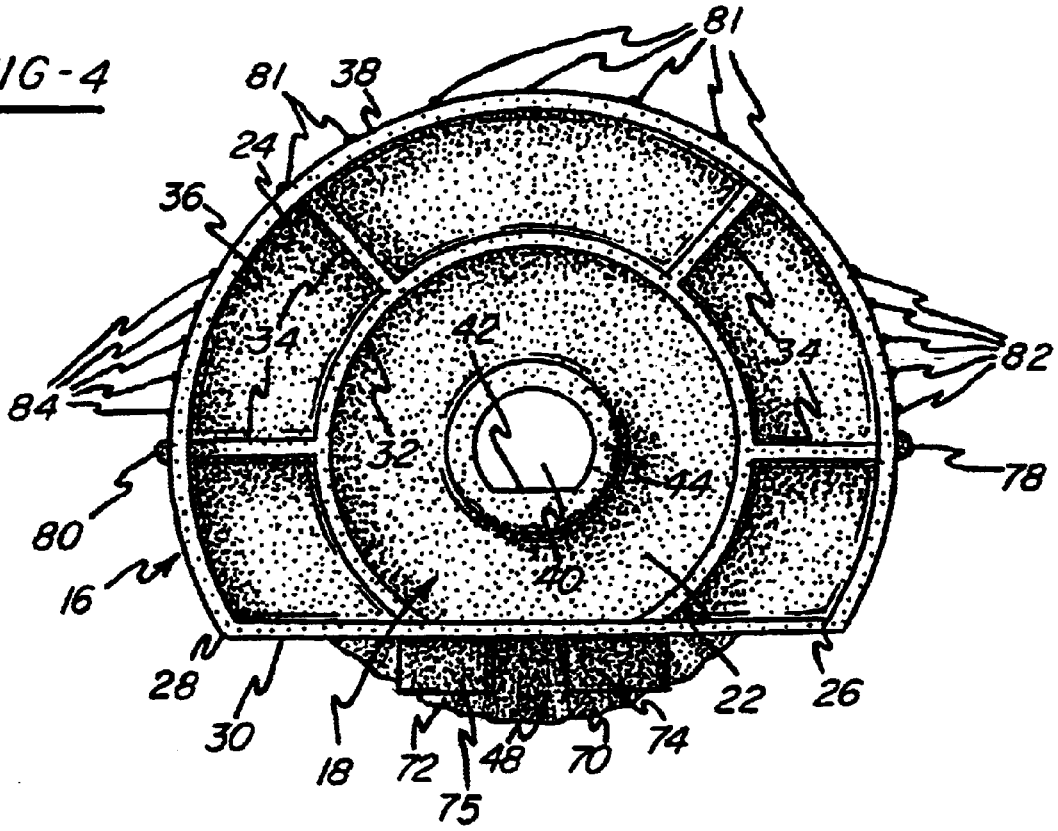
FIG. 4 is a rear side elevational view of the base member assembly with the fastener pin and threaded thumb screw removed.
Figure 5:
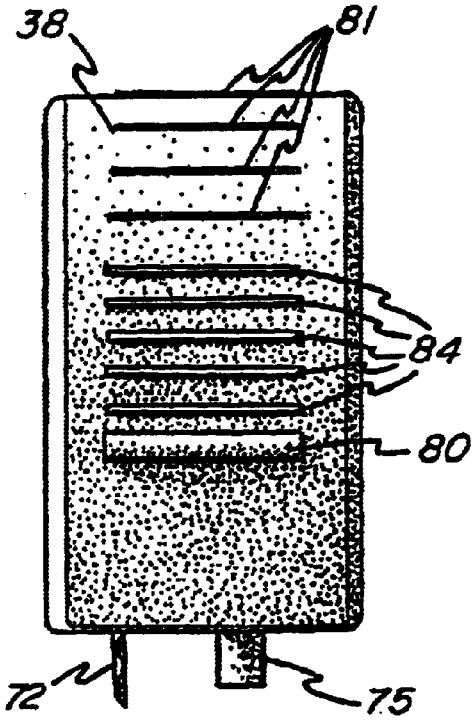
FIG. 5 is an elevational end view of the base member assembly.

Referring to FIGS. 1, 4 and 5, the base member assembly 12 comprises a base member 16 which is preferably formed as a molded member and is preferably formed of a moldable plastic material such as Delrin. The base member 16 includes a vertical supporting wall 18 comprising opposing generally planar sides 20 and 22. The supporting wall 18 includes a circular upper edge 24 defining an arc of a circle extending around the supporting wall 18 approximately 245°. The circular upper edge 24 terminates at terminal lower edges 26, 28, and a straight bottom edge 30 extends between the terminal lower edges 26, 28.

Referring to FIG. 4, the planar side 22 of the supporting wall 18 defines a back side for the base member 16 and includes a plurality of structural supporting webs extending outwardly therefrom, comprising a circular arc supporting web 32 and a plurality of radially extending supporting webs 34 extending outwardly from the circular arc supporting web 32. The radially extending supporting webs 34 terminate along an inside edge 36 of a guard flange 38 which extends around and is integral with the circular upper edge 24. The guard flange 38 extends axially from the planar sides 20, 22 of the supporting wall 18.

As may be further seen in FIG. 4, the supporting wall 18 includes an aperture 40 extending therethrough. The aperture 40 is generally circular, having a center located at a diametrical center of the supporting wall 18, with reference to the substantially circular upper edge 24. In addition, the aperture 40 includes a flat 42 extending generally parallel to the bottom edge 30 of the base member 16. A raised bearing surface 44 extends around the aperture 40 and defines a planar surface spaced from the planar side 22 of the supporting wall 18.

Referring to FIG. 1, the planar side 20 of the supporting wall 18 includes a circular bearing ridge 46 extending axially outwardly from the planar side and surrounding the aperture 40. The bearing ridge 46 defines a bearing surface for a circular blade 48, and in particular is adapted to engage a planar central area 50 surrounding a blade aperture 52.

A fastener pin 54 is provided for extending through the blade aperture 52 and the aperture 40 in the supporting wall 18 to support the blade 48 for rotation relative to the base member 16, and thereby complete the base member assembly 12. The fastener pin 54 includes an enlarged head 56 for engaging the planar portion 50 of the blade 48, a circular section portion 58 for engaging through the apertures 52 and 40, and a threaded portion 60 for engagement with a thumb screw 62 adjacent the rear planar side 22 of the support member 18. A wavy washer 66 is provided sandwiched between the bearing surface 44 and the thumb screw 62 to provide a spring biased tension for maintaining the head 56 of the fastener pin 54 in engagement with the blade 48.

The circular section portion 58 of the fastener pin 54 is provided with at least one flat 68 for engagement with the flat 42 of the aperture 40 whereby the fastener pin 54 is prevented from rotating relative to the base member 16 during rotation of the blade 48.

It should be noted that in addition to the substantially planar portion 50 located centrally on the blade 48, the blade 48 is provided with an outer cutting edge 70. The outer cutting edge 70 may be provided with any one of a plurality of configurations including wavy or deckled edges, or other edge configurations. It should be understood that the blade 48 is interchangeable by releasing the thumb nut 62 and removing the fastener pin 54. Further, it should be noted that the peripheral edge of the blade 48 extends outwardly a radial distance which is less than the radial distance from the aperture 40 to the upper edge 24 of the supporting wall 18, and that the blade 48 includes an exposed portion 72 (see FIG. 4) which extends outwardly beyond the bottom edge 30 of the base member 16.

Referring to FIGS. 4 and 5, an elongated guide structure in the form of guide tabs 74, 75 is formed integrally with and extends downwardly from the bottom edge 30 of the supporting wall 18, and it should be understood that a single tab structure may equivalently be provided in place of the two tabs 74, 75. The guide tabs 74, 75 are elongated in the direction between the terminal lower edges 26, 28, and extend downwardly a distance less than the outward extent of the exposed portion 72 of the blade 48. The guide tabs 74, 75 are adapted for engagement within a guide slot of a template for guided cutting of sheet material, as will be described further below.

It should be understood that a front extent 76 of the guard flange 38 (see FIG. 1) extends axially outwardly over the edge 70 of the blade 48 to thereby provide a shield for protecting a user's fingers from contacting the edge 70 of the blade 48 over a substantial portion of the blade edge 70 when the blade 48 is in position on the base member 16.

Referring further to FIGS. 1, 4 and 5, the guard flange 38 is further provided with a pair of elongated latching ridges 78, 80 extending radially outwardly from the guard flange 38 at diametrically opposed locations, and elongated in the axial direction. In addition, a plurality of elongated gripping ridges 82, 84 are provided adjacent the latching ridges 78, 80, respectively, and smaller ridges 81 are located across the top of the guard flange 38 for facilitating gripping of the base member assembly 12 between a user's thumb and fingers. The elongated gripping ridges 82, 84 and smaller ridges 81 extend axially outwardly from the guard flange 38 to a height less than the height of the latching ridges 78, 80.

Figure 6:
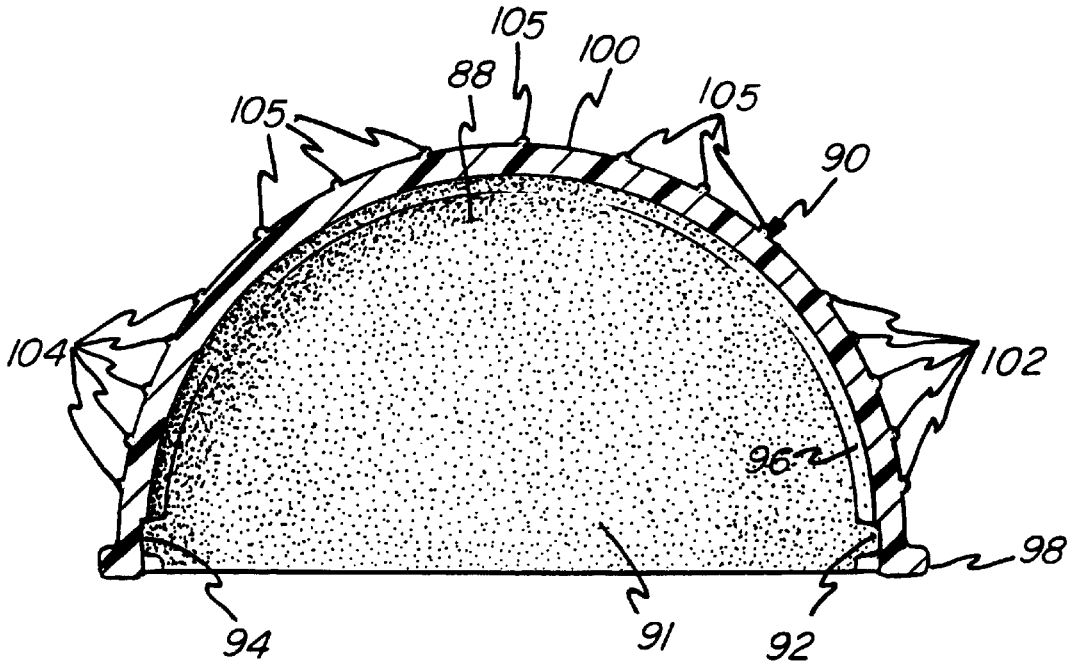
FIG. 6 is a side elevational cross-sectional view of the cover member.

Referring to FIG. 6, the cover member 14 is preferably formed of a resilient material, and is preferably formed of Santoprene. The cover member 14 includes generally semicircular front and rear walls 86 and 88, respectively (see also FIG. 1), having top edges which are connected by an arcuate top edge wall 90. A cavity 91 is defined within the cover member 14 by the front and rear walls 86, 88 and the top edge wall 90.

A pair of slots 92, 94 are defined on an inner surface 96 of the top edge wall 90. The slots 92, 94 are located at diametrically opposed positions on the inner surface 96 for engagement with the elongated latching ridges 78, 80 of the base member assembly 12 whereby the cover member 14 may be releasably latched in engagement with the base member assembly 12.

The cover member 14 further includes a lower outwardly extending lip 98 located adjacent and extending around the lower edge of the cover member 14. Further, an outer surface 100 of the top edge wall 90 includes a plurality of elongated gripping ridges 102 and 104 adjacent the locations of the slots 92 and 94, respectively, as well as smaller ridges 105. The gripping ridges 102, 104 and smaller ridges 105 facilitate gripping of the cover member 14 between an operator's thumb and fingers.

Figure 7:
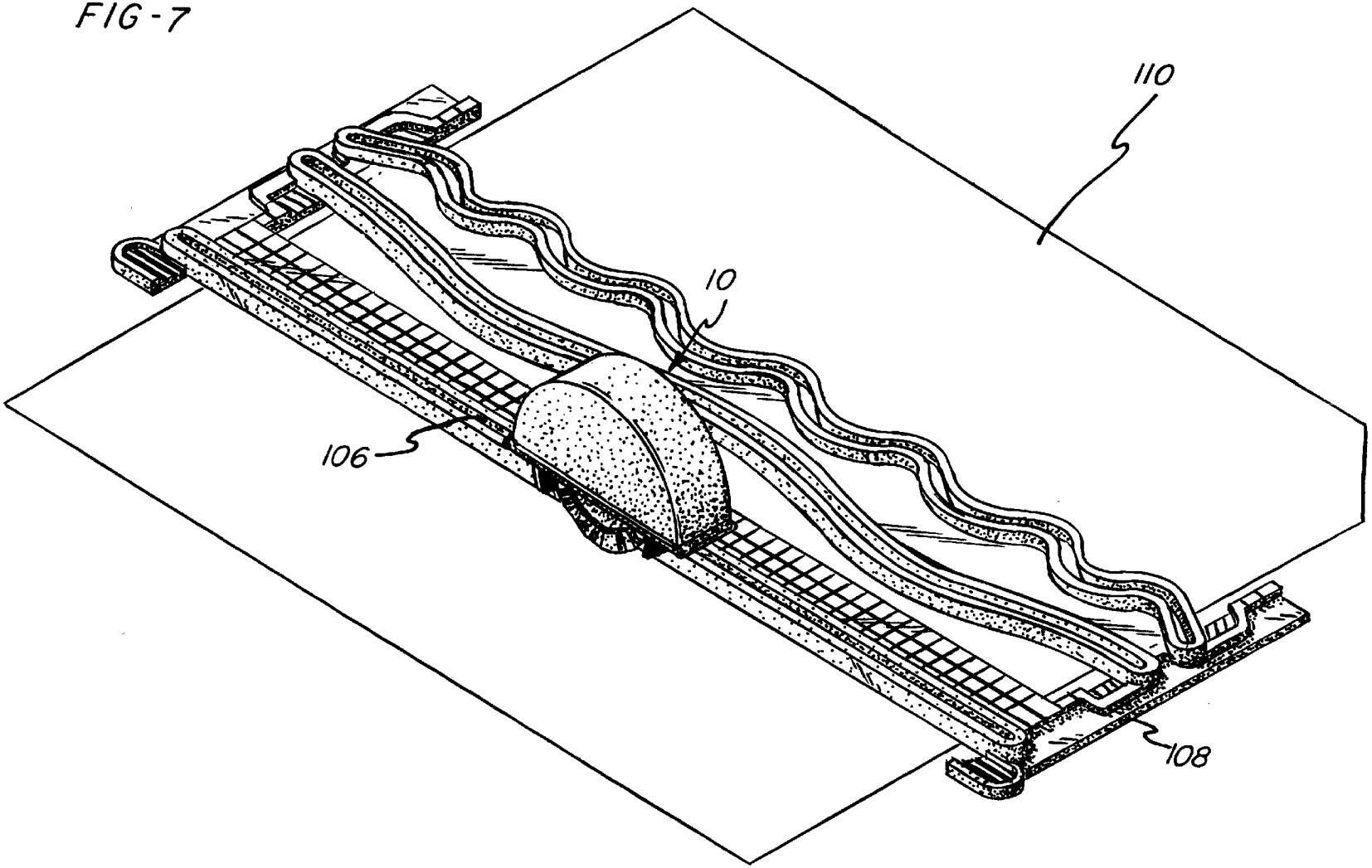
FIG. 7 is a perspective view showing the blade unit of the present invention as it is used with a template.

As noted previously, and shown in FIGS. 2 and 7, the cover member 14 is positionable on the base member assembly 12 in a use, cutting position. In this position, the latching ridges 78, 80 of the base member assembly 12 are engaged within the slots 92, 94 of the cover member 14 with the exposed portion 72 of the blade 48 and the guide tabs 74, 75 extending outwardly away from the cavity 91 of the cover member 14 whereby the cover member 14 is retained on the base member assembly 12 for manual guided movement by an operator. In particular, the present blade unit 10 is designed for guided movement along a straight edge guide slot 106 provided on a template 108. Specifically, the elongated tabs 74, 75 of the base member assembly 12 are adapted to be guided along the slot 106 while the edge 70 of the blade 48 is guided in cutting movement across a sheet material 110, such as a photograph, and in a preferred use of the invention the photograph is supported on a cutting mat to avoid scratching an underlying surface and to avoid dulling the blade 48.

It should be noted that the use of a low friction material, such as Delrin, for the base member 16 provides for low friction contact with the template 108, as well as providing for low friction contact at the bearing ridge contact with the blade 48.

In a second position of the cover member 14 relative to the base member assembly 12, the cover member 14 is removed from the base assembly 12 and repositioned such that the exposed portion 72 of the blade 48 is located extending into the cavity 91 of the cover member 14, with the slots 92, 94 of the cover member 14 again engaged with the latching ridges 78, 80 of the base member assembly 12. In this configuration, the cover member 14 protects the exposed edge 70 of the blade 48 from contact and provides a convenient storage configuration for the blade unit 10, as is illustrated in FIG. 3. Also, it should be noted that in the storage configuration, although a portion of the front surface of the blade 48 is exposed, the guard flange 38 provides a protective shield for effectively preventing contact with the sharp edge 70 of the blade 48.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A blade unit for cutting sheet material, said blade unit comprising:

a base member including a supporting wall having a generally planar side and defining a substantially circular upper edge;

an aperture extending through said supporting wall at a diametrical center of said supporting wall with reference to said substantially circular upper edge;

an axis pin extending through said aperture, said axis pin including a flat portion for cooperating with a flat portion of aid aperture to prevent rotation of said axis pin in said aperture;

a circular bearing ridge extending axially from said planar side of said supporting wall;

said substantially circular upper edge of said supporting wall including terminal lower edges;

said supporting wall including a straight bottom edge extending between said terminal lower edges;

a circular cutting blade supported for rotation on said axis pin, said blade including an exposed portion extending past said bottom edge of said supporting wall;

an elongated guide structure extending downwardly from said bottom edge of said supporting wall for engagement in guide slot of a cutting template for guiding movement of the blade unit;

a guard flange extending around aid substantially circular upper edge of said supporting wall and protruding axially form said planar side of said supporting wall;

a pair of elongated latching ridges protruding radially to a predetermined height from said guard flange at diametrically opposite locations;

a plurality of elongated gripping ridges protruding radially from said guard flange to a height less than the height of said latching ridges, and located adjacent each of said latching ridges;

a cover member including generally semi-circular front and rear walls;

an arcuate top edge wall extending between said front and rear walls of said cover member to define a cavity bounded by said top edge wall and said front and rear walls;

a pair of slots defined on inner surfaces of said top edge wall at diametrically opposed locations on said cover member for receiving said latching ridges of said base member;

a plurality of elongated gripping ridges protruding radially from, an outer surface of said top edge wall and located at diametrically opposed locations adjacent the locations of said slots on said cover member; and wherein said base member is positionable in engagement within said cover member in first and second positions, said first position comprising said latching ridges located in engagement with side slots and said exposed portion of said blade located extending away from said cavity, and said second position comprising said latching ridges located in engagement with said slots and said exposed portion of said blade located into said cavity.

* * * * *